US011355880B2

(12) United States Patent
Huang et al.

(10) Patent No.: US 11,355,880 B2
(45) Date of Patent: Jun. 7, 2022

(54) COAXIAL CONNECTOR WITH AXIALLY-FLOATING INNER CONTACT

(71) Applicant: CommScope Technologies LLC, Hickory, NC (US)

(72) Inventors: Mulan Huang, Jiangsu (CN); David J. Smentek, Lockport, IL (US); Yujun Zhang, Jiangsu (CN); Jin Liu, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 0 days.

(21) Appl. No.: 17/014,247

(22) Filed: Sep. 8, 2020

(65) Prior Publication Data

US 2021/0083415 A1 Mar. 18, 2021

(30) Foreign Application Priority Data

Sep. 16, 2019 (CN) ..... 201910870083.2

(51) Int. Cl.
*H01R 13/15* (2006.01)
*H01R 24/40* (2011.01)
*H01R 103/00* (2006.01)

(52) U.S. Cl.
CPC ..... *H01R 13/15* (2013.01); *H01R 24/40* (2013.01); *H01R 2103/00* (2013.01)

(58) Field of Classification Search
CPC ..... H01R 13/15; H01R 24/40; H01R 2103/00
USPC ..... 439/583
See application file for complete search history.

(56) References Cited

U.S. PATENT DOCUMENTS 3,587,033 A * 6/1971 Brorein ..... H01R 9/0521 439/322
4,941,846 A * 7/1990 Guimond ..... H01R 24/542 439/180
5,066,249 A * 11/1991 Doye ..... H01R 9/0518 439/585
5,217,391 A * 6/1993 Fisher, Jr. ..... H01R 24/44 439/578

(Continued)

FOREIGN PATENT DOCUMENTS

KR 20050057961 A 6/2005
KR 101826317 B1 2/2018

(Continued)

OTHER PUBLICATIONS

"International Search Report and Written Opinion corresponding to International Application No. PCT/2020/049673 dated Dec. 11, 2020".

(Continued)

*Primary Examiner* — Alexander Gilman
(74) *Attorney, Agent, or Firm* — Myers Bigel, P.A.

(57) ABSTRACT

A retractable pin includes: a cylindrical body, a retractable member with an insertion cavity at one end, and a spring disposed in a spring cavity defined by the combination of the retractable member and the cylindrical body. Upon application of a force to a free end of the retractable member, the retractable member is configured to retract into the cylindrical body by means of compression of the spring. This invention is further directed to a coaxial connector including a retractable pin as described above.

20 Claims, 7 Drawing Sheets

(56) References Cited

U.S. PATENT DOCUMENTS 5,775,927 A * 7/1998 Wider ..... H01R 13/635 439/188
5,907,138 A * 5/1999 Metzler ..... H01H 13/64 200/1 B
5,921,793 A * 7/1999 Phillips ..... H01R 24/46 439/188
6,314,779 B1 * 11/2001 Kesinger ..... B21C 3/08 72/125
6,685,492 B2 * 2/2004 Winter ..... G01R 1/0466 439/219
7,121,297 B2 * 10/2006 Thoms ..... F15B 11/0413 137/489
7,416,444 B1 * 8/2008 Lin ..... H01R 13/2421 200/51.1
7,717,756 B1 * 5/2010 Yin ..... H01R 13/2421 439/700
7,908,741 B2 * 3/2011 Chawgo ..... H01R 9/0518 29/751
7,914,348 B1 * 3/2011 Lin ..... H01R 12/724 439/700
7,934,954 B1 * 5/2011 Chawgo ..... H01R 24/56 439/578
8,337,256 B1 * 12/2012 Lin ..... H01R 12/7094 439/700
8,419,468 B2 * 4/2013 Alrutz ..... H01R 13/622 439/578
8,556,638 B2 * 10/2013 Tsubaki ..... H01R 12/7076 439/66
8,591,255 B2 * 11/2013 Holliday ..... H01R 9/05 439/583
8,911,266 B2 * 12/2014 Kawate ..... H01R 13/6596 439/700
9,093,783 B2 * 7/2015 Grimm ..... H01R 24/005
9,112,323 B2 * 8/2015 Goebel ..... H01R 4/48
9,490,592 B2 * 11/2016 Chastain ..... H01R 13/15
9,711,917 B2 * 7/2017 Montena ..... H01R 24/38
9,793,624 B2 * 10/2017 Tremba ..... H01R 9/0524
9,923,308 B2 * 3/2018 Holland ..... H01R 13/6581
10,096,923 B2 * 10/2018 Oda ..... B23K 35/262
10,340,638 B2 * 7/2019 Goebel ..... H01R 24/525
10,468,804 B2 * 11/2019 Kawamura ..... H01R 13/2421
10,530,104 B2 * 1/2020 Zhang ..... H01R 43/20
10,535,942 B2 * 1/2020 Sugiura ..... H01R 13/08
2004/0214462 A1 * 10/2004 Huang ..... H01R 24/46 439/188
2004/0242062 A1 * 12/2004 Hughes ..... H01R 24/52 439/540.1
2008/0057782 A1 * 3/2008 Berthet ..... H01R 24/50 439/581
2009/0243640 A1 * 10/2009 Katsuma ..... G01R 1/06722 324/762.01
2010/0178798 A1 * 7/2010 Rosenberger ..... H01R 24/542 439/578
2010/0261382 A1 * 10/2010 Montena ..... H01R 24/564 439/584
2012/0088407 A1 * 4/2012 Natoli ..... H01R 24/564 439/585
2013/0267115 A1 * 10/2013 Mark ..... G06F 1/20 439/485
2014/0024233 A1 * 1/2014 Holland ..... H01R 13/08 439/131
2014/0024234 A1 * 1/2014 Holland ..... H01R 13/08 439/131
2015/0038009 A1 * 2/2015 Gibson ..... H01R 24/525 439/578
2016/0006145 A1 * 1/2016 Goebel ..... H01R 13/6582 439/345
2017/0047683 A1 * 2/2017 Yanase ..... H01R 13/6315
2019/0013618 A1 * 1/2019 Barbet ..... H01R 24/40
2020/0102796 A1 * 4/2020 Anderson ..... E21B 43/128
2020/0106215 A1 * 4/2020 Montena ..... H01R 13/635
2021/0083415 A1 * 3/2021 Huang ..... H01R 13/6315

FOREIGN PATENT DOCUMENTS

WO 2012048260 A1 4/2012
WO 2017133838 A1 8/2017

OTHER PUBLICATIONS

"International Preliminary Report on Patentability corresponding to International Application No. PCT/2020/049673 dated Mar. 31, 2022".

* cited by examiner

COAXIAL CONNECTOR WITH AXIALLY-FLOATING INNER CONTACT

RELATED APPLICATION

This application claims priority from and the benefit of Chinese Application No. 201910870083.2, filed Sep. 16, 2019, the disclosure of which is hereby incorporated herein in its entirety.

FIELD OF THE INVENTION

The present invention relates generally to electrical cable connectors and, more particularly, to ganged connector assemblies.

BACKGROUND

Coaxial cables are commonly utilized in RF communications systems. Coaxial cable connectors may be applied to terminate coaxial cables, for example, in communication systems requiring a high level of precision and reliability.

Connector interfaces provide a connect/disconnect functionality between a cable terminated with a connector bearing the desired connector interface and a corresponding connector with a mating connector interface mounted on an apparatus or a further cable. Some coaxial connector interfaces utilize a retainer (often provided as a threaded coupling nut) that draws the connector interface pair into secure electro-mechanical engagement as the coupling nut, rotatably retained upon one connector, is threaded upon the other connector.

Alternatively, connection interfaces may be also provided with a blind mate characteristic to enable push-on interconnection, wherein physical access to the connector bodies is restricted and/or the interconnected portions are linked in a manner where precise alignment is difficult or not cost-effective (such as the connection between an antenna and a transceiver that are coupled together via a rail system or the like). To accommodate misalignment, a blind mate connector may be provided with lateral and/or longitudinal spring action to accommodate a limited degree of insertion misalignment, or "float". Blind mated connectors may be particularly suitable for use in "ganged" connector arrangements, in which multiple connectors (for example, four connectors) are attached to each other and are mated to mating connectors simultaneously.

Another instance of multiple connection interfaces is the use of connectors in "board-to-board" (B2B) connections. In such installations, two printed circuit boards (PCBs) (typically disposed parallel to each other) serve as mounting locations for arrays of coaxial connectors. Because the locations of the connectors are set once the connectors are mounted on the PCBs, there may also be a need for float between mating connectors.

SUMMARY

As a first aspect, embodiments of the present invention are directed to a coaxial connector comprising: a retractable pin, including a cylindrical body defining a first cavity open to a proximal end of the cylindrical body, a retractable member including a second cavity open to a proximal end of the retractable member and a third cavity open to a distal end of the retractable member, and a spring, wherein the spring extends between a spring base and a spring front end within a spring cavity defined by the first and third cavities; an outer conductor body surrounding the retractable pin; and a dielectric layer disposed between the retractable pin and the outer conductor body.

As a second aspect, embodiments of the present invention are directed to a coaxial connector comprising: a retractable pin, including a cylindrical body, and proximal and distal retractable members extending in each axial direction away from the cylindrical body, and a spring. The cylindrical body defines a center cavity open to both proximal and distal ends of the cylindrical body, the proximal retractable member defines a first insertion cavity open to a proximal end of the proximal retractable member and a first internal cavity open to a distal end of the proximal retractable member, and the distal retractable members defines a second insertion cavity open to a distal end of the distal retractable member and a second internal cavity open to a proximal end of the distal retractable member. The spring extends between a proximal end and a distal end of a spring cavity defined by the center cavity of the cylindrical body and the first and second internal cavities of the proximal and distal retractable members, respectively. The coaxial connector further comprises: an outer conductor body surrounding the retractable pin; and a dielectric layer disposed between the retractable pin and the outer conductor body.

As a third aspect, embodiments of the present invention are directed to a female coaxial connector adapter comprising: a retractable pin, including a cylindrical body defining a first cavity open to a proximal end of the cylindrical body, a retractable member including a second cavity open to a proximal end of the retractable member and a third cavity open to a distal end of the retractable member, and a spring, wherein the spring extends between a spring base and a spring front end within a spring cavity defined by the first and third cavities; an outer conductor body surrounding the retractable pin; and a dielectric layer disposed between the retractable pin and the outer conductor body. The connector is configured to mate with male interfaces at proximal and distal ends of the connector.

DETAILED DESCRIPTION

Figure 1:
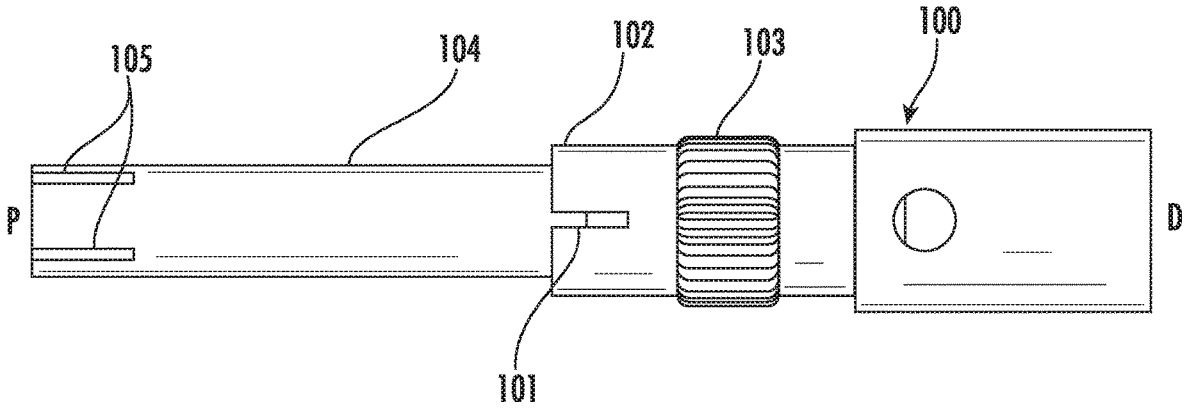
FIG. 1 is a transverse view of a retractable pin, according to embodiments of the invention.

The present invention is described with reference to the accompanying drawings, in which certain embodiments of the invention are shown. This invention may, however, be embodied in many different forms and should not be construed as limited to the embodiments that are pictured and described herein; rather, these embodiments are provided so that this disclosure will be thorough and complete, and will fully convey the scope of the invention to those skilled in the art. It will also be appreciated that the embodiments disclosed herein can be combined in any way and/or combination to provide many additional embodiments.

Like numbers refer to like elements throughout. In the figures, certain layers, components or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

Unless otherwise defined, all technical and scientific terms that are used in this disclosure have the same meaning as commonly understood by one of ordinary skill in the art to which this invention belongs. The terminology used in the below description is for the purpose of describing particular embodiments only and is not intended to be limiting of the invention. As used in this disclosure, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It will be understood that when an element is referred to as being "on," "attached to," "connected to," "coupled with," "contacting," etc., another element, it can be directly on, attached to connected to, coupled with or contacting the other element or intervening elements may also be present. In contrast, when an element is referred to as being, for example, "directly on," "directly attached to," "directly connected to," "directly coupled with," or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under", "below", "above", "over", "upper", "lower", "left", "right" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. The device may be otherwise oriented (rotated 90 degrees or at other orientations) and the descriptors of relative spatial relationships used herein interpreted accordingly.

As used herein, phrases such as "between X and Y" and "between about X and Y" should be interpreted to include X and Y. As used herein, phrases such as "between about X and Y" mean "between about X and about Y." As used herein, phrases such as "from about X to Y" mean "from about X to about Y."

The letters "P" and "D" as used in the drawings indicate the "proximal" and "distal" directions. Phrases referring to the "proximal" end or side of an element can be assumed to be referring to a portion that is closer to the P than other portions of that same element, unless explicitly specified otherwise. Similarly, phrases referring to the "distal" end or side of an element can be assumed to be referring to a portion that is closer to the D than other portions of that same element, unless explicitly specified otherwise.

Figure 2:
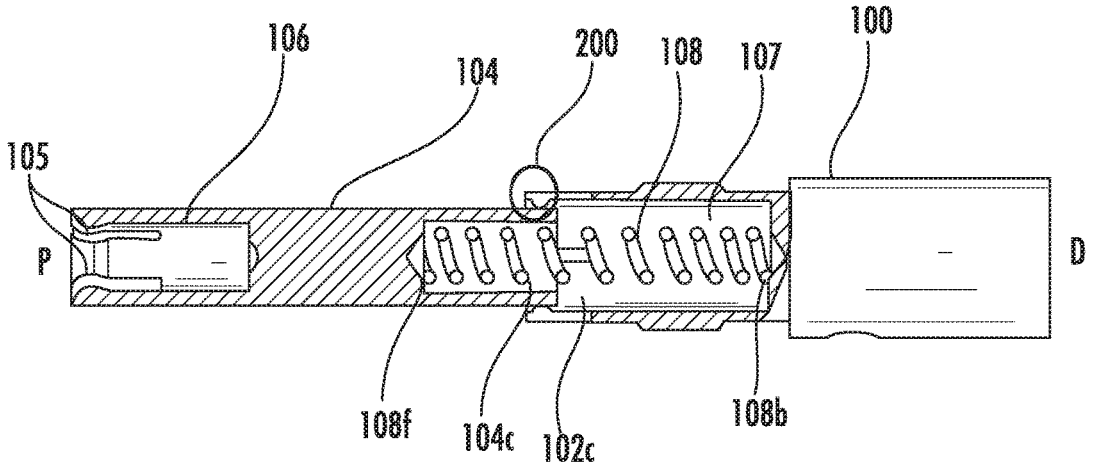
FIG. 2 is a sectional view of the retractable pin of FIG. 1.

Referring now to the drawings, a retractable pin, designated broadly at 100, is shown in FIGS. 1 and 2. As best seen in FIG. 1, the retractable pin 100 comprises a cylindrical body 102 and a retractable member 104 extending axially away from the cylindrical body 102 in a proximal direction. The cylindrical body 102 may include a plurality of axial slits 101 at its proximal end. In some embodiments, there may be between four and six axial slits 101 at the proximal end of the cylindrical body 102. The retractable member 104 may also include at least one axial slit 105 at its proximal end. The outer surface of the cylindrical body 102 may include at least one grip region 103. The cylindrical body 102 and retractable member 104 may be formed from a conductive material, such as a metal.

As best seen in FIG. 2, the cylindrical body 102 defines a center cavity 102*c* open to a proximal end of the cylindrical body 102. Moreover, the retractable member 104 of the retractable pin 100 defines an insertion cavity 106 open to the proximal end of the retractable member 104. The retractable member 104 may also define an internal cavity 104*c* open to a distal end of the retractable member 104. The axial slit 105 of the retractable member 104 may extend through the walls of the retractable member 104 that define the insertion cavity 106. The retractable pin 100 further includes a spring cavity 107. The spring cavity 107 may be defined by the internal cavity 104*c* of the retractable member 104 and the center cavity 102*c* of the cylindrical body 102. The spring cavity 107 includes a spring 108, which may extend between a spring base 108*b* and a spring front end 108*f*.

In some embodiments, the spring 108 may be soldered to the inner surface of the spring cavity 107 at the spring front end 108*f* and the spring base 108*b*. If the spring 108 is soldered, then the spring 108 may contact both the spring front end 108*f* and spring base 108*b* at all times without the need to keep the spring 108 in a constant state of compression. The spring 108 may therefore be in an uncompressed state when no force is being exerting on the retractable member 104. Furthermore, the spring 108 may act as the coupling means between the cylindrical body 102 and the retractable member 104.

In other embodiments, the spring 108 may not be soldered to the inner surface of the spring cavity 107. In order that the spring 108 may constantly span the full length of the spring cavity 107, the spring 108 may be configured to be in a semi-compressed state even when no force is exerted on the retractable member 104. In order to prevent the spring 108 from restoring to full extension, a pin holding mechanism 200 such as that shown in FIG. 3 may be used.

The pin holding mechanism 200 comprises at least one inner flange 202 extending radially outwardly from the distal end of the retractable member 104 and an outer flange 204 extending radially inwardly from the proximal end of the cylindrical body 102. The proximal end of the cylindrical body 102 "overlaps" the distal end of the retractable member 104 such that the outer flange 204 is disposed on the proximal side of the inner flange 202. While the retractable pin 100 is in its initial position (i.e. no external force is being exerted on the free end of the retractable member 104 toward the distal end of the retractable pin 100), the outer flange 204 is configured to engage with the inner flange 202. In some embodiments, the inner flange 202 may comprise two inner flanges spaced at a distance apart, known as primary and secondary inner flanges.

Figure 3:
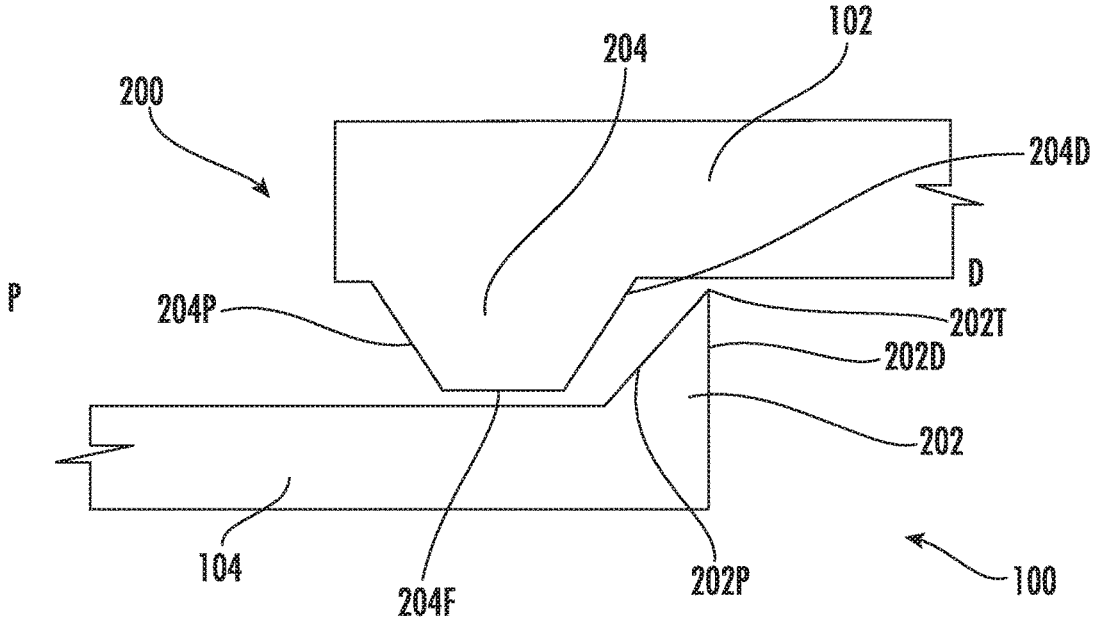
FIG. 3 is an enlarged view of the pin holding mechanism of FIG. 2.

As shown in FIG. 3, the inner flange 202 may have a substantially triangular cross-section, wherein the distal edge 202D of the inner flange 202 extends radially outwardly from the surface of the retractable member 104 in a direction substantially normal to the surface of the member 104. The proximal edge 202P of the inner flange 202 may extend radially outwardly at an acute angle from the surface of the retractable member 104 until joining the distal edge 202D at a point 202T.

The outer flange 204 may have a trapezoidal cross-section. A proximal edge 204P and a distal edge 204D of the outer flange 204 may extend radially inwardly at acute angles from the surface of the cylindrical body 102 such that each edge 204P, 204D approaches the other. Both edges 204P, 204D are connected by a cylindrical mid-section 204F, which, in cross-section, forms a substantially flat base 204F between the two sloped edges 204P, 204D of the trapezoid.

Figure 4:
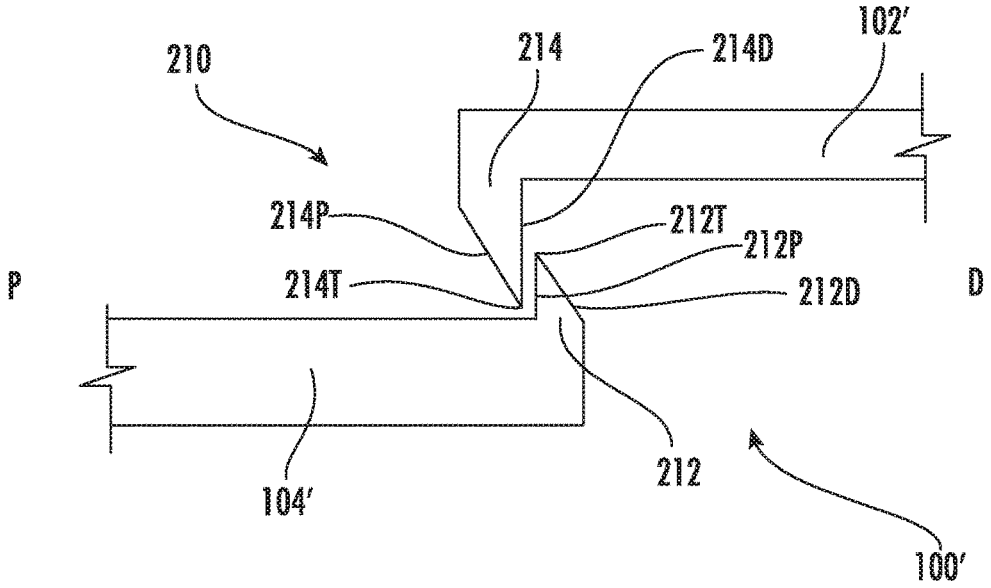
FIG. 4 is an enlarged view of another pin holding mechanism, according to embodiments of the invention.

Referring now to FIG. 4, in other embodiments, a pin holding mechanism 210 may include an inner flange 212 extending radially outwardly from the distal end of a retractable member 104' and having a reversed orientation from the inner flange 202 in FIG. 3, such that the proximal edge 212P extends in a direction substantially normal to the surface of the retractable member 104' and the distal edge 212D extends at an acute angle to join the proximal edge 212P at a point 212T.

The pin holding mechanism 210 may include an outer flange 214 having a substantially triangular cross-section, wherein the distal edge 214D of the outer flange 214 extends radially inwardly from the surface of the cylindrical body 102' in a direction substantially normal to the surface of the body 102'. The proximal edge 214P of the outer flange 214 may extend radially inwardly at an acute angle from the surface of the cylindrical body 102' until joining the distal edge 214D at a point 214T.

Figure 5:
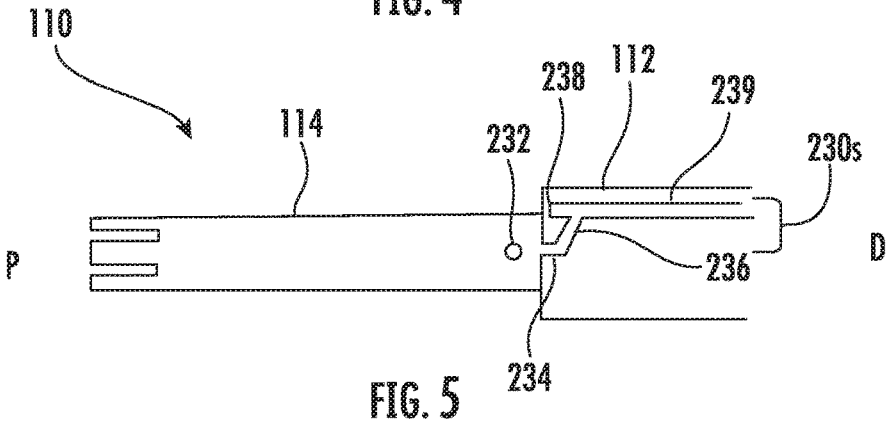
FIG. 5 is an enlarged view of a still further pin holding mechanism, according to embodiments of the invention.

As can be seen in FIG. 5, some embodiments may include a retractable pin 110 having a cylindrical body 112 and a retractable member 114. The cylindrical body 112 includes at least one containment slide 230*s*, comprising a first axial slot 234 open to the proximal side of the cylindrical body 112, a sloping slot 236, and second axial slot 239. The sloping slot 236 extends from the distal end of the first axial slot 234 to the second axial slot 239. A generally semicircular groove 238 may be included at the proximal end of the second axial slot 239. The retractable member 114 may comprise at least one locking peg 232. The locking peg 232 may be a punctiform projection, or may be a variety of other shapes, including, but not limited to, a cylindrical or rectangular projection. Furthermore, the at least one containment slide 230*s* may be a plurality of containment slides 230*s* and the at least one locking peg 232 may be a plurality of locking pegs 232.

Figure 6:
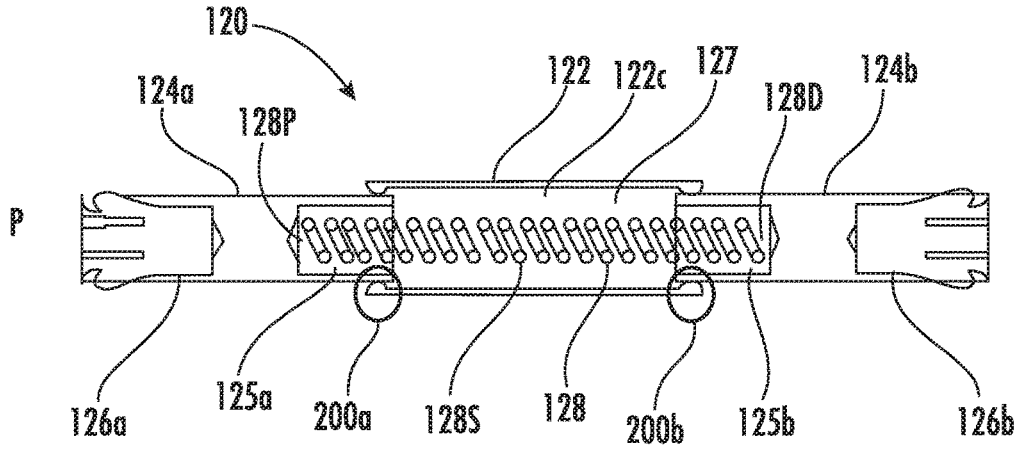
FIG. 6 is a sectional view of another retractable pin, according to embodiments of the invention.

As can be seen in FIG. 6, some embodiments may include a retractable pin 120 having two retractable members 124*a*, 124*b* extending axially outwardly in opposite directions from a cylindrical body 122. The cylindrical body defines a center cavity 122*c*. The proximally extending retractable member 124*a* defines a first insertion cavity 126*a* open to the proximal end of the member 124*a*. The proximally extending retractable member 124*a* also defines a first internal cavity 125*a* open to the distal end of the member 124*a*. The distally extending retractable member 124*b* defines a second insertion cavity 126*b* open to the distal end of the member 124*b*. The distally extending retractable member 124*b* also defines a second internal cavity 125*b* open to the proximal end of the member 124*b*. The retractable pin 120 defines an inner spring cavity 127 holding a spring 128 extending from a proximal position 128P within the proximally extending retractable member 124*a* to a distal position 128D within the distally extending retractable member 124*b*. The internal spring cavity 127 is defined by the first and second internal cavities 125*a*, 125*b* of the retractable members 124*a*, 124*b* and the center cavity 122*c* of the cylindrical body 122. The spring 128 may be soldered, or otherwise maintained, at a soldering position 128S within the cylindrical body 122. Pin holding mechanisms 200 such as those shown in FIGS. 3-5 may be used to couple the cylindrical body 122 to each retractable member 124*a*, 124*b*. Alternatively, in some embodiments, the spring 128 may be soldered to the inside of the spring cavity 127 at the proximal position 128P and distal position 128D.

Figure 7A:
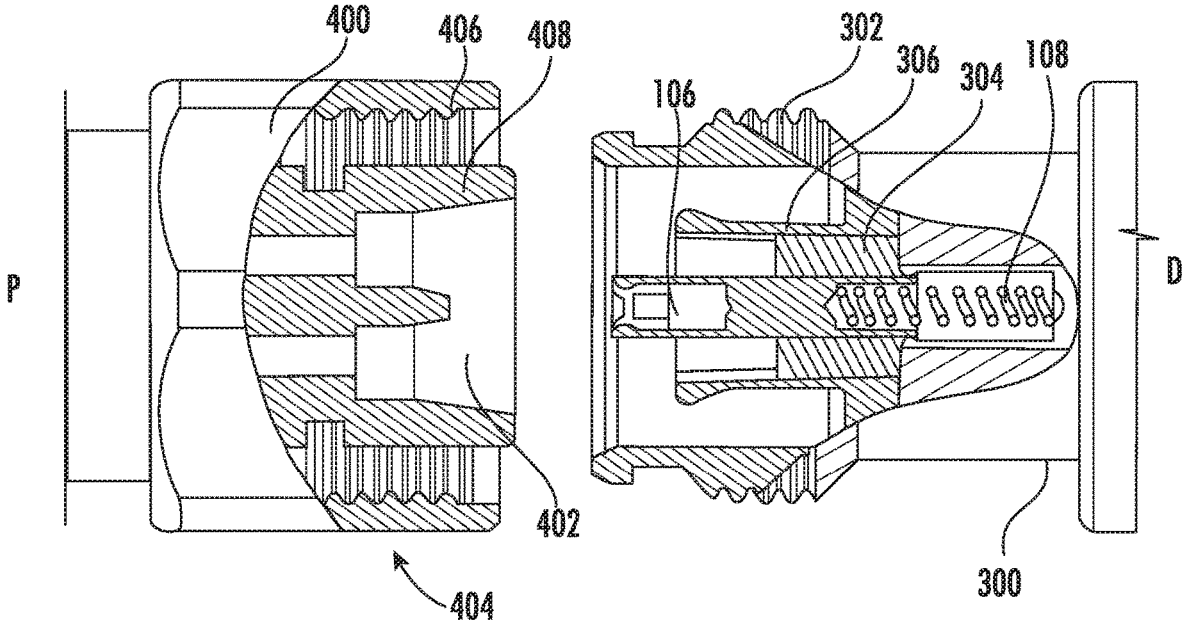
FIGS. 7A and 7B are sectional views of a male connector before and after mating with a female connector including the retractable pin of FIG. 1.
Figure 7B:
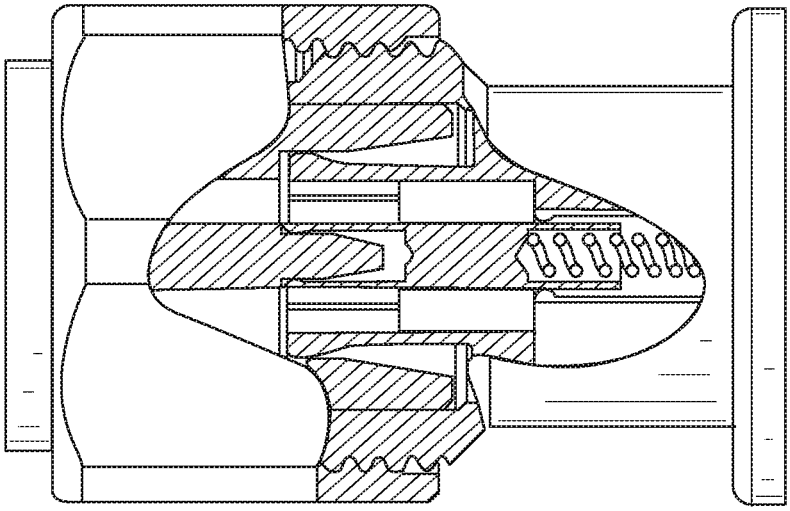
Figure 8:
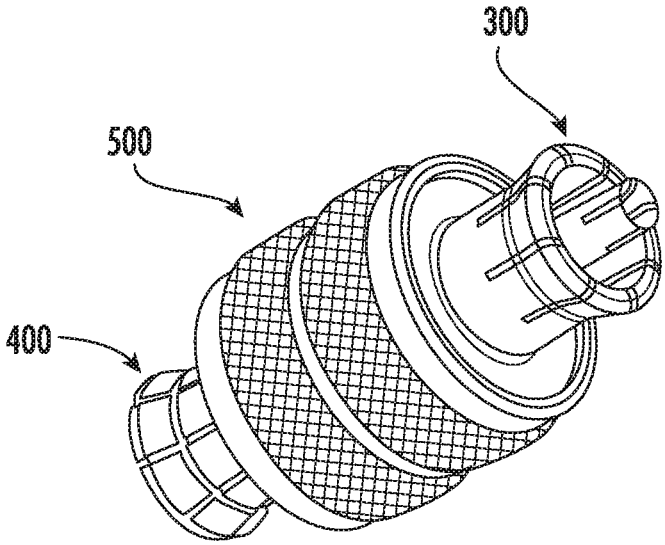
FIG. 8 is an isometric view of a female-female adapter including the retractable pin of FIG. 1.
Figure 9:
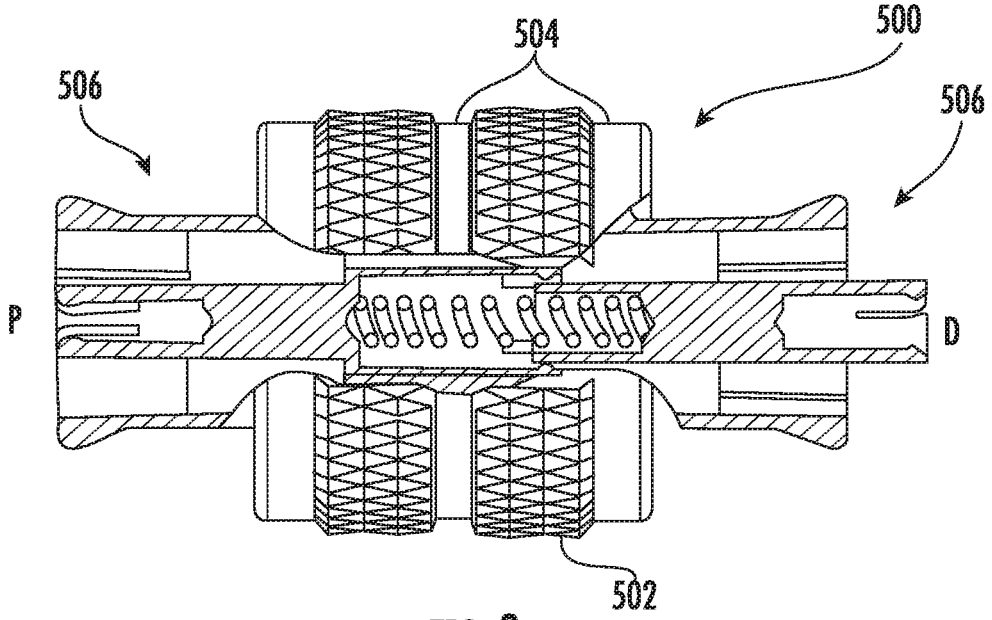
FIG. 9 is a sectional view of the female-female adapter of FIG. 8.

As can be seen in FIGS. 7A and 7B, the retractable pin 100 may be positioned within a female type connector, designated broadly at 300. Surrounding the retractable pin 100 is a dielectric layer 304, which is surrounded by an outer conductor body 306. The female type connector 300 may further include external threads 302. A male type connector, designated broadly at 400, may be configured to mate with the female type connector 300. The male type connector 400 includes a contact pin 402 configured to fit within the insertion cavity 106 of the retractable pin 100. The male type connector 400 further includes an outer conductor body 408 configured to engage with the outer conductor body 306 of the female type connector 300. A coupling nut 404 may be rotatably retained on the male type connector 400. The coupling nut 404 may comprise internal threads 406 configured to engage with the external threads 302 of the female type connector 300.

As illustrated in FIGS. 8-10C, the retractable pin 100 may also be disposed within a female-female adapter, designated broadly at 500. The female-female adapter 500 may have a central body 502 comprising gripping surfaces 504 on its outside surface. The female-female adapter 500 may also include two end portions 506 extending axially outwardly from the central body 502.

Figure 10A:
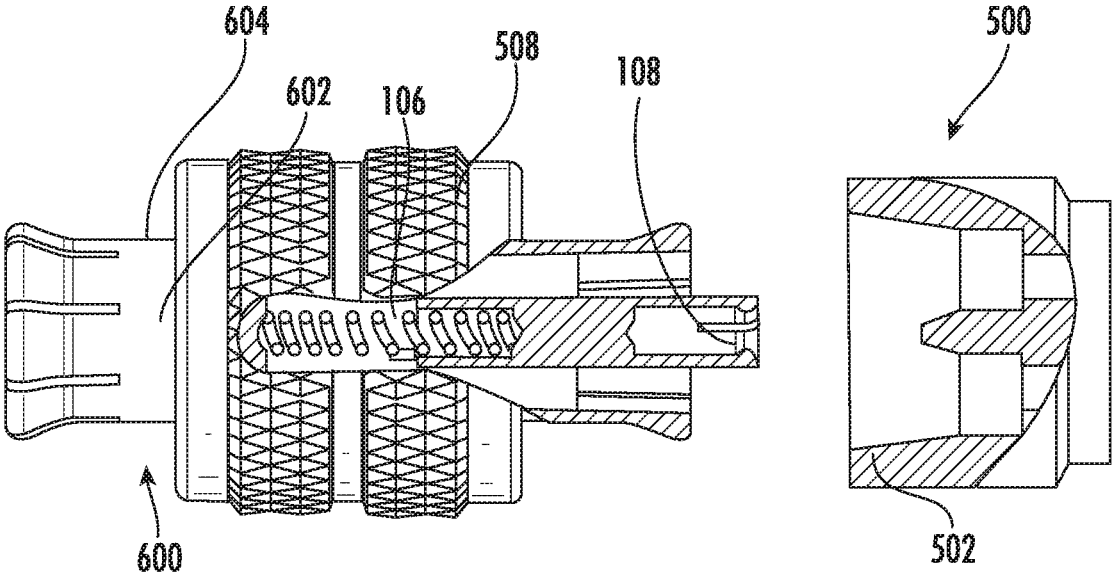
FIGS. 10A-C are sectional views of a connector assembly, including the female-female adapter of FIG. 8 and further including a corresponding male interface portion in unmated, partially mated, and fully mated positions.
Figure 10B:
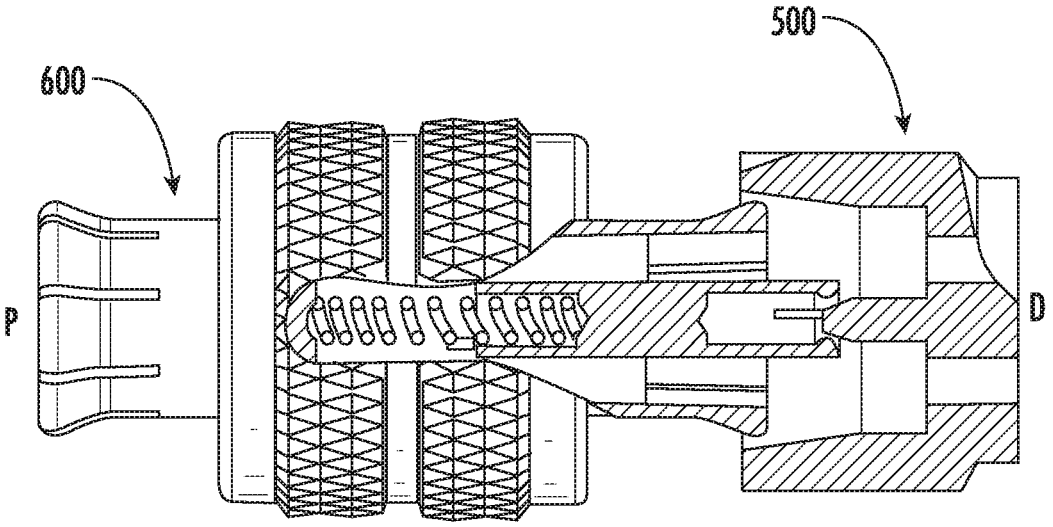
Figure 10C:
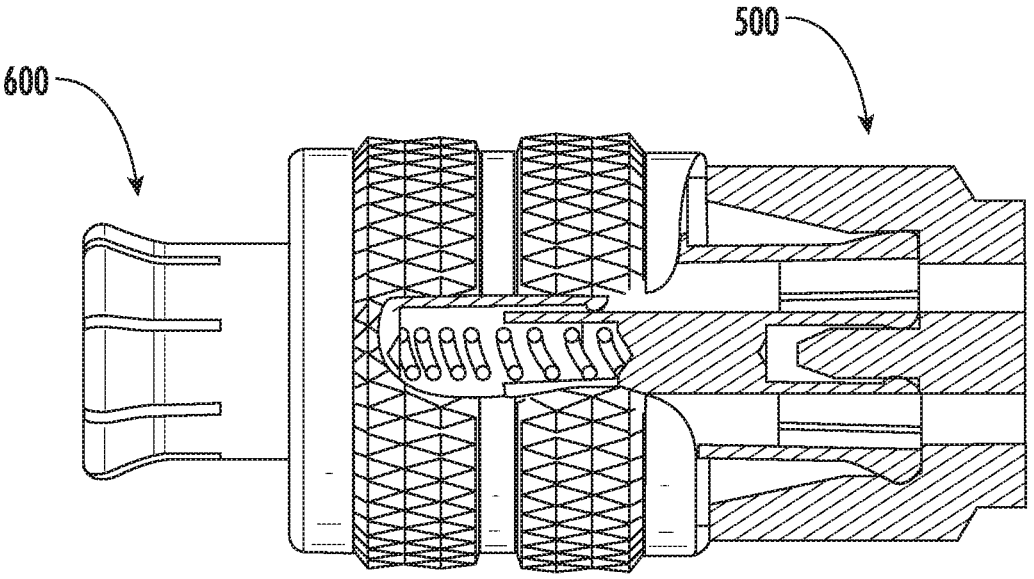
Figure 11:
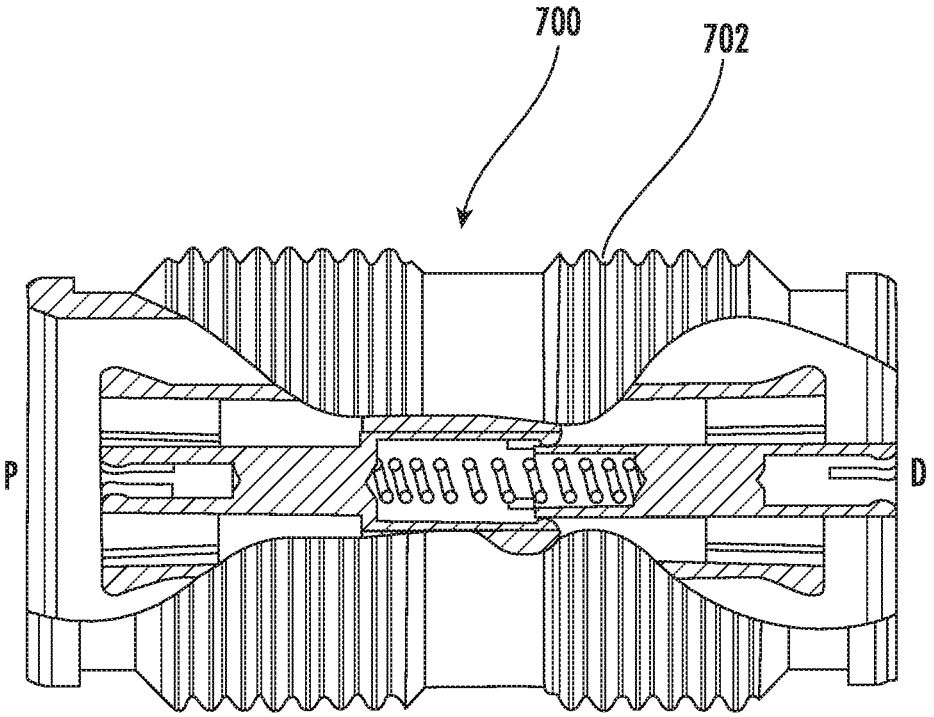
FIG. 11 is a sectional view of the female-female adapter of FIG. 8, wherein the female-female adapter is surrounded by a casing.

The end portions 506 of the female type adapter 500 are each configured to mate with a male interface 600, as shown in FIGS. 10A-C. A central pin 602 of the male interface 600 is configured to fit within the internal cavity 106 of the retractable pin 100 within the female-female adapter 500. An outer conductor body 604 of the male interface 600 is configured to receive and engage with the outer conductor body 508 of an end portion 506 of the female-female adapter 500. The female-female adapter 500 may be fit within a casing 700, as shown in FIG. 11. The outer surface of the casing 700 may include several threaded regions 702, which may be used to connect the casing 700 to a larger cable assembly.

The retractable pin 100 is configured such that the retractable member 104 is capable of moving axially relative to the cylindrical body 102 and therefore acts as a "floating" pin. As the retractable member 104 is moved axially toward a distal end of the pin 100, the spring 108 of the retractable pin 100 compresses. The movement of the retractable member 104 may be limited by the maximum extent of compression of the spring 108. The inclusion of axial slits 101 at the proximal end of the cylindrical body 102 may allow the cylindrical body 102 to expand if the retractable member 104 applies radial contact force to the inner surface of the cylindrical body 102. The expansion of the cylindrical body 102 may allow for a decrease in the degree of Passive Intermodulation ("PIM") distortion for the retractable pin 100, leading to improved performance.

For a retractable pin 100 comprising a retractable member 104 including two inner flanges 202, the inclusion of both primary and second inner flanges 202 may allow the pin holding mechanism to set two different stop positions. Due to the triangular shape of each inner flange 202, as the retractable member 104 is pushed toward the cylindrical body 102, the outer flange 204 of the cylindrical body 102 may deflect outwardly over the secondary inner flange 202. Once force is no longer being applied to the retractable member 104, the substantially flat proximal edge 202P of the secondary inner flange 202 may frictionally engage with the outer flange 204, thereby preventing further expansion.

With regard to the pin holding mechanism shown in FIG. 5, the cylindrical body 112 and retractable member 114 are initially separate and uncoupled pieces. The locking peg 232 of the retractable member 114 may be aligned with the first axial slot 234 of the containment slide 230*s* of the cylindrical body 112. The locking peg 232 may then be pushed to the distal end of the first axial slot 234, at which point the retractable member 114 may be rotated relative to the cylindrical body 112, so as to allow the locking peg 232 to reach the second axial slot 239 via the sloping slot 236. Because the sloping slot 236 extends both radially and distally from the first axial slot 234, the retractable member 114 will rotate relative to the cylindrical body 112 while forced toward the distal end of the pin 110. After reaching the second axial slot 239, external force on the pin 110 may be removed, allowing restoring force of the spring 108 to push the retractable member 114 radially outwardly such that the locking peg 232 is allowed to rest in the semicircular groove 238 and thus to act as a stop. This mechanism may allow the retractable member 114 and cylindrical body 112 to be coupled and decrease the time and/or cost required to create the retractable pin 110.

As shown in FIG. 7, the retractable pin 100 may be situated within a female type connector 300. As a male type connector 400 is brought into contact with the female type connector 300, the contact pin 402 of the male type connector 400 may fit within the insertion cavity 106 of the retractable pin 100. The engagement between the contact pin 402 and the inner wall of the insertion cavity 106 causes the retractable member 104 of the retractable pin 100 to be pushed to the distal end of the female type connector 300, causing the spring 108 to compress. In order to keep the connectors 300, 400 in contact, coupling nut 404 rotatably retained on the male type connector 400 may be rotated such that inner threads 406 of the coupling nut 404 engage with outer threads 302 located on the outside surface of the female type connector 300. The restoring force of the spring 108 is unable to cause sufficient force so as to separate the two connectors 300, 400 once the coupling nut 404 has been threaded over the female type connector 300.

The "float" characteristic of the retractable pin within the female type connector 300 or within a female-female adapter 500 may allow the contact pins 402 of male type connectors 400 to be effectively galvanically coupled with the pin 100 of the female type connector 300 when the male type connector 400 is within a relatively wide range of distance away from the female type connector 300. The "float" characteristic may be particularly advantageous in situations in which the male type connector 400 has its position set before connection such that it may be incapable of being brought within a narrow range of distance from the female type connector 300.

The use of a retractable pin 120 with two retractable members 124*a*, 124*b*, as shown in FIG. 6, may be useful in combination with a female-female adapter 500, as the pin 120 may allow for a "float" characteristic on both ends of the adapter 500. This may be particularly useful for a situation in which two male interfaces 600, which are both to connect to the female-female adapter 500 are positioned at a set distance apart before interconnection. This distance may be too close or too far apart for existing adapters to accommodate both interfaces 600. The "float" characteristic may therefore allow both male interfaces 600 to connect through the same female-female adapter 500.

For a retractable pin 120 with two retractable members 124, it may be useful to solder the internal spring 128 to an inner surface of the spring cavity 127 at a soldering points 128S with the cylindrical body 122. Soldering the spring 128 may decouple the proximal and distal ends of the spring 128, allowing the "float" characteristics of each retractable member 124*a*, 124*b* to not interfere with one another.

Embodiments of this invention are not intended to limit the use of the retractable pin 100 to female type connectors. In some embodiments, the retractable pin 100 may be used as a contact pin for a male type connector.

Those of skill in this art will appreciate that the retractable pins 100 discussed above may vary in configuration. For example, the pin holding mechanism 200 may comprise primary and secondary outer flanges 204 affixed to the cylindrical body 102 instead of or in combination with primary and second inner flanges 202, so as to create two stop positions. Furthermore, those of skill in the art will appreciate that the inner flange 202 may be spaced some distance away from the end of the retractable member 104, and the outer flange 204 may be spaced some distance away from the end of the cylindrical body 102.

Those of skill in this art will appreciate that, though only a retractable pin 100 with a single retractable member 104 is shown inside of a female-female adapter 500, a pin 120 with two retractable members 124*a*, 124*b* may also be used in conjunction with the female-female adapter 500. Similarly, retractable pins 100 with any manner of pin holding mechanism 200 herein described or those wherein the spring 108 is soldered to the inner surface of the spring cavity 107 may be used in conjunction with the female-female adapter 500 or the female type connector 300.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention as defined in the claims. The invention is defined by the following claims, with equivalents of the claims to be included therein.

That which is claimed is:

1. A coaxial connector, comprising:

a retractable pin, including a cylindrical body defining a first cavity open to a proximal end of the cylindrical body, a retractable member including a second cavity open to a proximal end of the retractable member, the second cavity comprising an inner wall configured to engage a contact pin inserted within the second cavity, and a third cavity open to a distal end of the retractable member, and a spring, wherein the spring extends between a spring base and a spring front end within a spring cavity defined by the first and third cavities;

an outer conductor body surrounding the retractable pin; and a dielectric layer disposed between the retractable pin and the outer conductor body.

2. The coaxial connector of claim 1, wherein the spring of the retractable member is attached to the inner surface of the spring cavity at the spring base and the spring front end.

3. The coaxial connector of claim 2, wherein the spring is soldered to the inner surface of the spring cavity at the spring base and the spring front end.

4. The coaxial connector of claim 1, wherein at least one inner flange extends radially outwardly from the distal end of the retractable member, and at least one outer flange extends radially inwardly from the proximal end of the cylindrical body.

5. The coaxial connector of claim 4, wherein the proximal end of the cylindrical body overlaps the distal end of the retractable member such that the at least one outer flange is disposed proximal to the at least one inner flange, and wherein when no force is being exerted on the retractable pin, the at least one outer flange is configured to engage with the at least one inner flange.

6. The coaxial connector of claim 4, wherein the at least one inner flange is two inner flanges.

7. The coaxial connector of claim 1, wherein the retractable member includes at least one locking peg disposed on its outer surface, and wherein the cylindrical body includes at least one containment slide comprising first and second axial slots, and a sloping slot connecting the first and second axial slots.

8. The coaxial connector of claim 1, wherein the outer surface of the connector includes external threads.

9. The coaxial connector of claim 1, wherein the coaxial connector is surrounded by an external casing.

10. The coaxial connector of claim 1, wherein the retractable pin further comprises a second retractable member coupled with the cylindrical body and extending in a direction opposite to that of the first retractable member, wherein the second retractable member also includes an insertion cavity in its distal end, and wherein the spring cavity lies partially within the second retractable member such that the spring front end is within the first retractable member and the spring base is within the second retractable member.

11. The coaxial connector of claim 10, wherein the spring is soldered to an inner surface of the spring cavity at a soldering position within the cylindrical body.

12. A coaxial connector, comprising:

a retractable pin, including a cylindrical body, and proximal and distal retractable members extending in each axial direction away from the cylindrical body, and a spring;

wherein the cylindrical body defines a center cavity open to both proximal and distal ends of the cylindrical body, the proximal retractable member defines a first insertion cavity open to a proximal end of the proximal retractable member, the first insertion cavity comprising an inner wall configured to engage a contact pin inserted within the first insertion cavity, and a first internal cavity open to a distal end of the proximal retractable member, and the distal retractable members defines a second insertion cavity open to a distal end of the distal retractable member, the second insertion cavity comprising an inner wall configured to engage a contact pin inserted within the second insertion cavity, and a second internal cavity open to a proximal end of the distal retractable member;

wherein the spring extends between a proximal end and a distal end of a spring cavity defined by the center cavity of the cylindrical body and the first and second internal cavities of the proximal and distal retractable members, respectively;

an outer conductor body surrounding the retractable pin; and a dielectric layer disposed between the retractable pin and the outer conductor body.

13. The coaxial connector of claim 12, wherein the spring is soldered to the inner surface of the spring cavity at the proximal and distal ends of the spring cavity.

14. The coaxial connector of claim 12, wherein at least one inner flange extends radially outwardly from a distal end of the proximal retractable member, and at least one outer flange extends radially inwardly from a proximal end of the cylindrical body.

15. The coaxial connector of claim 14, wherein the proximal end of the cylindrical body overlaps the distal end of the proximal retractable member such that the at least one outer flange is disposed proximal to the at least one inner flange, and wherein while no force is being exerted on the retractable pin, the at least one outer flange is configured to engage with the at least one inner flange.

16. The coaxial connector of claim 14, wherein the at least one inner flange is two inner flanges.

17. The coaxial connector of claim 12, wherein the retractable member includes at least one locking peg disposed on its outer surface, and wherein the cylindrical body includes at least one containment slide comprising first and second axial slots, and a sloping slot connecting the first and second axial slots.

18. The coaxial connector of claim 12, wherein the spring is soldered to an inner surface of the spring cavity at a soldering position within the cylindrical body.

19. The coaxial connector of claim 12, wherein the connector is mated with male type connectors at both axial ends.

20. A female coaxial connector adapter, comprising:

a retractable pin, including a cylindrical body defining a first cavity open to a proximal end of the cylindrical body, a retractable member including a second cavity open to a proximal end of the retractable member and a third cavity open to a distal end of the retractable member, and a spring, wherein the spring extends between a spring base and a spring front end within a spring cavity defined by the first and third cavities;

wherein at least one inner flange extends radially outwardly from the distal end of the retractable member, and at least one outer flange extends radially inwardly from the proximal end of the cylindrical body, wherein the proximal end of the cylindrical body overlaps the distal end of the retractable member such that the at least one outer flange is disposed proximal to the at least one inner flange, and wherein when no force is being exerted on the retractable pin, the at least one outer flange is configured to engage with the at least one inner flange;

an outer conductor body surrounding the retractable pin; and a dielectric layer disposed between the retractable pin and the outer conductor body;

wherein the connector is configured to mate with male interfaces at proximal and distal ends of the connector.

* * * * *